United States Patent [19]

Brooke

[11] 3,977,779

[45] Aug. 31, 1976

[54] ELECTROSTATOGRAPHIC TRANSFER WITH AIR

[75] Inventor: Edric R. Brooke, Welwyn Garden City, England

[73] Assignee: Xerox Corporation, Stamford, Conn.

[22] Filed: Sept. 30, 1974

[21] Appl. No.: 510,335

[30] Foreign Application Priority Data

Dec. 21, 1973 United Kingdom ..... 59530/73

[52] U.S. Cl. ..... 355/3 R; 96/1.4

[51] Int. Cl.[2] ..... G03G 15/00

[58] Field of Search ..... 355/3 TR, 3 R, 10, 17; 96/1.4, 1 LY

[56] References Cited

UNITED STATES PATENTS 3,751,156 8/1973 Szostak ..... 355/3 TR 3,847,478 11/1974 Young ..... 355/3 TR

OTHER PUBLICATIONS

"Pressurized Corona Method for Transferring Developed Electrostatic Images" by K. A. Krause IBM Tech. Bull. vol. 14, No. 2, July 1971, p. 582.

*Primary Examiner*—R. L. Moses

*Attorney, Agent, or Firm*—James J. Ralabate; Clarence A. Green; William A. Henry, II

[57] ABSTRACT

An electrostatographic system in which liquid developer material in an image pattern on a photoconductive plate is transferred to a support material by pressing the latter against the plate by air pressure from a perforated chamber adjacent to, but spaced from the plate. The perforations may be angled in the direction of movement of the plate, and the chamber may have an inclined wall.

2 Claims, 4 Drawing Figures

ELECTROSTATOGRAPHIC TRANSFER WITH AIR

Figure 1:
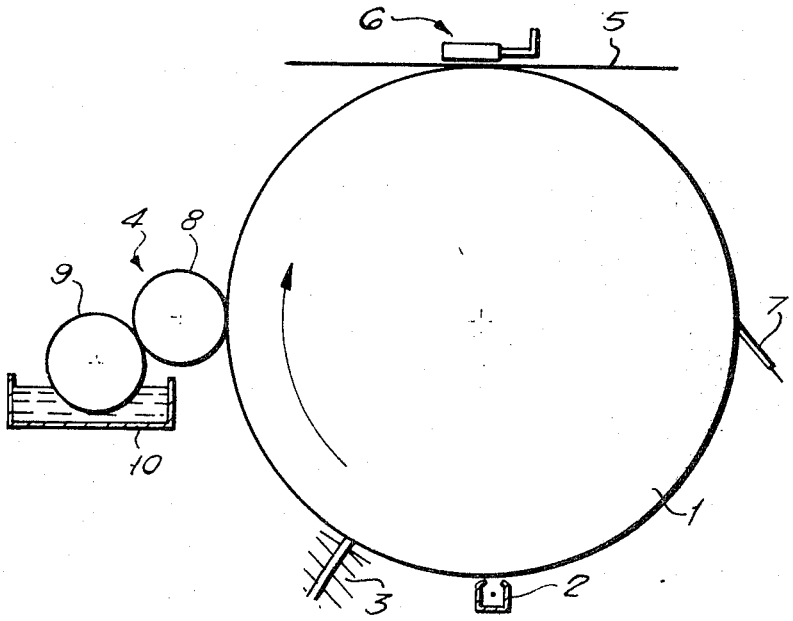

This invention relates to electrostatography, and more particularly to the transfer of imaging material in electrostatography.

In one well-known form of automatic xerographic reproduction machine, a moving photoconductive plate, generally in the form of an endless surface, such as a drum, belt, or the like, is first uniformly charged and the surface then exposed to a light pattern of the image sought to be reproduced thereby to discharge the charge in the areas where light strikes the plate. The undischarged areas of the plate thus form an electrostatic charge pattern in conformity with the configuration of the original image pattern.

The electrostatic latent image may then be developed into visible form by applying a developer material, e.g., a powder, generally referred to as toner, to the plate using any one of a number of development means generally known and used in the art. Subsequent to the development operation, developer material constituting the now visible image is transferred from the plate to a sheet of final support material such as paper or the like and suitably affixed to it thereby forming a permanent print.

Instead of being developed by means of a powder, the latent image may be developed using a liquid as described, for example, in U.S. Pat. No. 3,084,043.

Following development of the electrostatic latent image using the techniques described in that specification, the liquid developer constituting the developed image is transferred to a support material such as paper by pressing the support material against the developed image, typically by means of a roller, usually referred to as a transfer roller.

Pressure contact between the paper or other support material and developer by means of a roller is also sometimes used to transfer an image which has been developed by means of a powder. For example, the paper may be coated on the side which will receive the image with an adhesive of the pressure sensitive type which is just tacky enough to pick up the powder image without adhering to the surface of the plate.

In an automatic electrostatographic apparatus employing pressure transfer as described above, it may occur, for example, due to a paper mis-feed, or exhaustion of the paper supply, that no paper will arrive at the transfer station to receive the developed image on the plate, in which case, unless some action is taken to avoid such occurrence the liquid developer constituting the developed image will transfer to the transfer roller. This will result in the liquid developer on the roller then off-setting onto the back of the next sheet of copy paper arriving at the transfer station, which is undesirable. One way of avoiding this is to provide means for detecting the absence of paper at the transfer station and camming the roller away from the plate when the absence of paper is detected. The same problem occurs where the support material, although fed to the transfer station in a timely manner, is narrower than the developed image, in which case a detector system, even if it is made more sophisticated, may not be able to avoid transfer of developer material to the pressure transfer roll in all circumstances.

It is an object of the present invention to provide an alternative solution to the problem outlined above.

To this end, from one aspect, the invention provides electrostatographic apparatus including means for directing air under pressure against a support material to press the latter against a photoconductive plate for transferring from the plate to the support material developer material on the plate in an image configuration.

One embodiment of automatic electrostatographic reproduction apparatus according to the invention includes a photoconductive plate, means for applying a uniform electrostatic charge to the plate, exposure means for exposing the charged plate to a pattern of light and shadow to produce an electrostatic latent image on the plate, developer means for applying developer material to the plate for developing charged areas of the plate, a transfer station for transferring said developer material to a support material, means for feeding support material to the transfer station, said transfer station including means for directing air under pressure against said support material to press the latter against the plate, and means for separating the support material from the plate following transfer.

It is to be understood that all of the developer material constituting the developed image on the plate will not normally be transferred and the references herein and in the claims to the transfer of developer material are not intended to mean that all the developer material is transferred from the plate to the spport material but rather that sufficient developer material is transferred to produce a visible and recognizable image on the latter.

Since some developer material will remain on the plate after transfer an automatic electrostatographic reproduction apparatus according to this invention capable of producing successive copies automatically from one or more originals should include cleaning means for removing the residual developer material.

Suitably the transfer means of this invention comprises a chamber to which air is fed under pressure and which has a porous or perforated wall facing the plate surface.

From another aspect, the invention provides an electrostatographic process in which developer material on a photoconductive plate is transferred to a support material by pressing the latter against the plate by air pressure.

An electrostatographic process of this invention may include the steps of: (a) applying a uniform electrostatic charge to a photoconductive plate, (b) exposing the charged plate to a pattern of light and shadow to produce an electrostatic latent image on the plate, (c) applying developer material to the charged areas of plate, (d) transferring developer material from the plate to a support material by pressing the latter against the plate by means of air pressure, and (e) separating the support material from the plate.

It is understood, of course, that the use of air pressure to hold paper to guide rollers or belts, and other conventional sheet handling arrangements are well known, including curved apertured air chambers.

Figure 2:
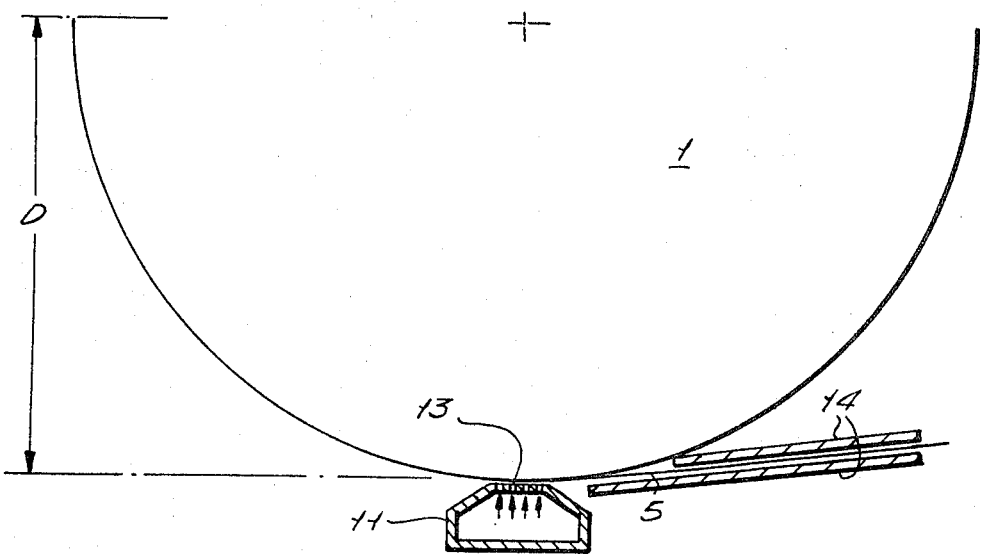
Figure 3:
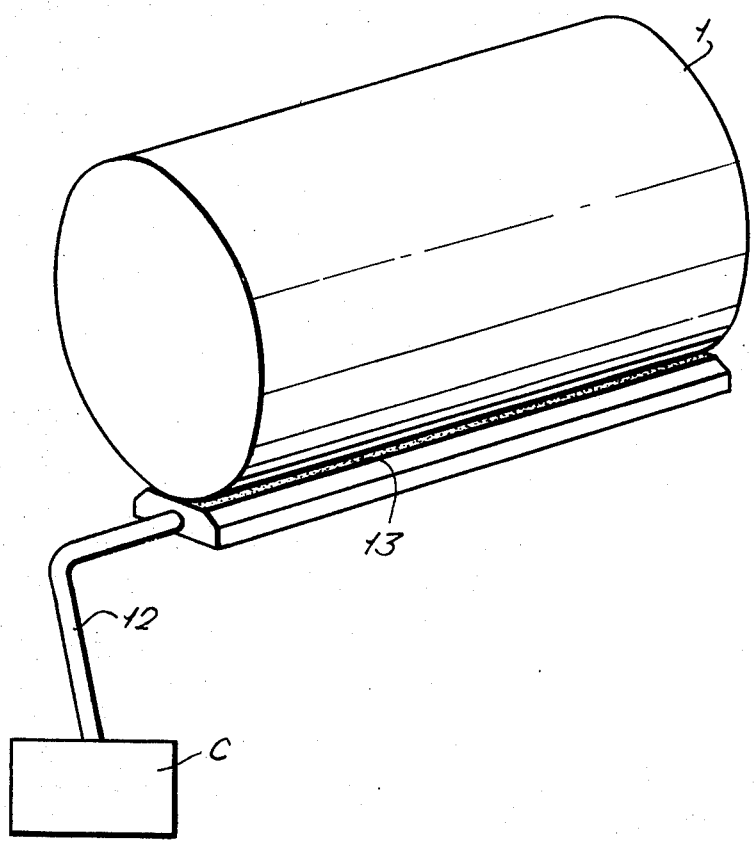
Figure 4:
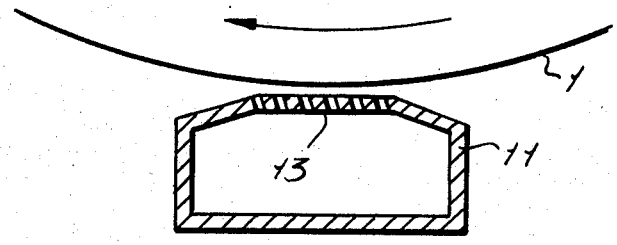

In order that the invention may be more readily understood reference will now be made to the accompanying drawings, in which:

FIG. 1 is a schematic cross-section illustrating the operation of one embodiment of an electrostatographic reproduction machine utilizing the transfer techniques of this invention, FIG. 2 is a schematic cross-section of an embodiment of transfer means according to the invention, FIG. 3 is a perspective view of the embodiment shown in FIG. 2, and FIG. 4 is a view similar to FIG. 2, showing a modification.

Referring to the drawings, the general operation of an electrostatographic machine as illustrated will first be described with reference to FIG. 1. A moving photoconductive plate, in this instance having an endless surface constituting the periphery of a drum 1, is first uniformly charged to a charging station 2 and the surface then exposed at an exposure station 3 to a light pattern of the image sought to be reproduced thereby to discharge the charge in the area where light strikes the plate surface. The undischarged areas of the surface thus form an electrostatic charge pattern in conformity with the configuration of the original image pattern.

The electrostatic latent image is then developed into visible form by the development system 4 by applying liquid developer material to the plate. Subsequent in the development operation the now visible image is transferred from the plate to a sheet of final support material 5, such as paper or the like, thereby to form a permanent print, at a transfer station in accordance with the present invention schematically illustrated at 6. The paper or the like is fed to the transfer station 6 by conventional means (not shown) programmed to deliver the paper in synchronism with the arrival of the developed image. Following transfer, residual developer remaining on the plate surface is removed by a cleaning blade 7 and collected for subsequent disposal. All elements excepting the transfer station 6 may be conventional.

The development system of the illustrated embodiment employs the techniques described in U.S. Pat. No. 3,084,043 in which the liquid developer is applied to the plate by means of an applicator, in this embodiment in the form of a roll 8 having a peripheral surface comprising lands and valleys such that the liquid developer is contained in the valleys out of contact with the plates, while the surfaces of the lands are in contact with the plate. In such an arrangement the liquid developer is attracted from the valleys to the electrostatic latent image in image configuration. The illustrated embodiment exemplifies a typical example of such an arrangement in which the applicator is a rigid cylindrical member 8 having on its surface a pattern of grooves and ridges which comprise the lands and valleys respectively, the liquid developer being maintained in the valleys below the surface of the lands.

As a plate surface bearing the electrostatic latent image and the applicator are brought into moving contact, the liquid developer is drawn to the plate surface from the valleys of the applicator roll by the charges which form the electrostatic latent image.

The applicator roll 8 is supplied with liquid developer by a developer supply roll 9 the lower portion of which is disposed in a tray 10 containing liquid developer. The surface of the developer supply roll 9 is arranged in liquid transfer relationship with the peripheral surface of the applicator roll 8 which latter is, in operation, arranged in pressure contact with the surface of the drum 1. Means are provided for driving both of the rolls 8 and 9 in synchronism, or substantially so, with the drum 1. The liquid developer system such as described above is more fully described and illustrated in our copending U.K. application Nos. 30010/73 and 59531/73, the latter being for a patent of addition to the former and filed concurrently therewith on Dec. 21, 1973.

Referring now to FIGS. 2 and 3, the transfer means illustrated comprises an air chamber 11 arranged at a finite distance D from the center line of the drum. The gap between the top surface of the chamber 11 and the peripheral surface of the drum 1 is variable according to the eccentricity of the drum periphery. Air is supplied under pressure to the chamber 11 through one or more inlets 12 from a suitable compressor C and exhausts through a porous or perforated wall 13 of the chamber facing the drum surface so as to apply even pressure to the paper across its width and forcing it against the drum surface. The porosity of the chamber wall 13 can be structural or produced by drilling an array of holes in the wall.

Sheets of paper or the like 5 are guided to the transfer station by suitable guides 14.

In the embodiment illustrated in FIGS. 2 and 3 the wall 13 is drilled to provide a multiplicity of uniformly disposed perforations arranged normally to the center line of the drum. In order to reduce the effects of turbulence which may occur with this arrangement as the leading edge of a support sheet arrives at the transfer station, the perforations may be angled in the direction of motion of the drum surface as illustrated in FIG. 4, or the wall 13 itself may be disposed at a suitable inclination to the drum surface to achieve the same non-tangential inclination of the apertures in the wall 13 in the direction of movement of the drum surface and the copy sheet.

In operation a sheet of paper or the like is fed to the transfer station in synchronism with the developed image on the drum surface and is pressed against the drum surface so that the liquid developer is transferred to the paper by the pressure of air from the chamber 11. The width of the perforated zone of the wall 13 in the peripheral zone of the wall 13 in the peripheral direction of the drum 1 may be varied as desired to achieve the required period of transfer.

Suitable conventional means (not illustrated) may be provided for detecting the arrival of the paper at the transfer zone and the air pressure is switched on in response to the detection of the leading edge of the paper sheet or other support material by the detection means. In this way the operation of the transfer air pressure can be avoided in the absence of paper. On the other hand in the case of a paper sheet which is narrower than the width of developer material applied to the drum, transfer will still be effected but without resulting in off-setting of developer to the transfer means beyond the edges of the paper sheet as would occur with a transfer pressure roll, since there is no physical contact of any roller or other transfer member with the image at any time. The air chamber 11 remains fixed in position spaced from the drum surface at all times.

It will be noted from the Figures that the air chamber 11 has an inclined sheet guide ramp surface leading up to and transitioning into the apertured air ejecting surface 13. This assists in guiding the sheet more closely in to the plate and over the apertured surface 13.

If the support material is sufficiently porous air can penetrate the paper and assist separation of the support material from the plate as the air endeavors to escape from under the leading edge of the support material. Beam strength of the paper and gravity can also provide sufficient sheet stripping means, although various known puffers, stripping fingers and the like can be additionally employed.

While particular embodiments of the invention have been described above, it will be appreciated that various modifications may be made without departing from the scope of the invention as defined in the appended claims.

What is claimed is:

1. Electrostatographic reproduction apparatus including a moving imaging plate, means for producing an electrostatic latent image on said plate, development means for applying liquid developer material to said plate and developing an image of said developer material on said plate of said electrostatic latent image, transfer means for transferring said developer material from said imaging plate to an image support material, and means for feeding image support material to said transfer station, wherein said transfer means comprises non-contacting means for directing air under pressure against said image support material to press said image support material against said plate, and wherein said transfer means comprises an air chamber adapted to receive air under pressure and having a narrow perforated air ejecting wall facing, but spaced from said plate surface and extending thereacross, and wherein said wall has perforations angled in the direction of movement of said plate.

2. The apparatus of claim 1, wherein said air chamber has an inclined sheet guide ramp leading up to and transitioning in to said perforated wall.

* * * * *